US007128319B2

(12) United States Patent
Finocchio

(10) Patent No.: US 7,128,319 B2
(45) Date of Patent: Oct. 31, 2006

(54) METHOD OF PLAYING A GAME OF CHANCE INCLUDING PURCHASE OF ADDITIONAL GAME PLAY INFORMATION AND SYSTEM FOR FACILITATING THE PLAY THEREOF

(75) Inventor: Richard Finocchio, Everett, MA (US)

(73) Assignee: GTech Rhode Island Corporation, West Greenwich, RI (US)

( * ) Notice: Subject to any disclaimer, the term of this patent is extended or adjusted under 35 U.S.C. 154(b) by 74 days.

(21) Appl. No.: 10/770,891

(22) Filed: Feb. 2, 2004

(65) Prior Publication Data

US 2005/0167921 A1 Aug. 4, 2005

(51) Int. Cl.
*A63F 3/06* (2006.01)

(52) U.S. Cl. ..... 273/139; 283/901; 283/903

(58) Field of Classification Search ..... 273/100–149, 273/250–299; 283/900–910
See application file for complete search history.

(56) References Cited

U.S. PATENT DOCUMENTS 5,374,060 A * 12/1994 Goldberg ..... 273/139
5,407,199 A 4/1995 Gumina
5,949,042 A * 9/1999 Dietz et al. ..... 235/375
6,435,500 B1 8/2002 Gumina

OTHER PUBLICATIONS

"Monopoly Game" at McDonald's, received in the US Patent and Trademark Office Mar. 8, 1997.*

* cited by examiner

*Primary Examiner*—Benjamin H. Layno
(74) *Attorney, Agent, or Firm*—Kenyon & Kenyon LLP

(57) ABSTRACT

A method for playing a game of chance and system for facilitating the play of the game are disclosed, in which an initial ticket containing initial game play information is received, a second ticket containing additional game play information is received, and the combination of the initial game play information and the additional game play information determines if the second ticket is a winning ticket.

35 Claims, 11 Drawing Sheets

600

| | | | | |
|---|---|---|---|---|
| 123456 | No | 2, 3, 9, 12 | 0$ | UNREDEEMED |
| 123457 | Yes | 1, 7, 6, 7 | 2$ | UNREDEEMED |
| 123458 | No | 1, 7, 8, 3 | 20$ | UNREDEEMED |
| 123459 | No | 12, 13, 19, 20 | 0$ | REDEEMED |

610

Figure 6a

610

660 650 620 630 640

| | | | | |
|---|---|---|---|---|
| 123458 | No | 1, 7, 8, 3 | 20$ | UNREDEEMED |

Figure 6b

700

| | | | |
|---|---|---|---|
| 223456 | 2, 3, 9, 12, 1, 4 | 0$ | UNREDEEMED |
| 223457 | 1, 7,.6, 7, 7, 17 | 20$ | UNREDEEMED |
| 223458 | 1, 7, 8, 3, 13, 3 | 2$ | UNREDEEMED |
| 223459 | 12, 13, 19, 20, 4, 2 | 0$ | REDEEMED |

710

Figure 7a

710

750 720 730 740

| | | | |
|---|---|---|---|
| 223458 | 1, 7, 8, 3, 13, 3 | 2$ | UNREDEEMED |

Figure 7b

METHOD OF PLAYING A GAME OF CHANCE INCLUDING PURCHASE OF ADDITIONAL GAME PLAY INFORMATION AND SYSTEM FOR FACILITATING THE PLAY THEREOF

A portion of the disclosure of this patent document contains material which is subject to copyright protection. The copyright owner has no objection to the facsimile reproduction by anyone of the patent document or patent disclosure as it appears in the Patent and Trademark Office patent file or records, but otherwise reserves all copyright rights whatsoever.

BACKGROUND INFORMATION

Lottery game tickets may be frequently sold in retail establishments such as convenience stores, liquor stores, and the like. These and other establishments selling lottery tickets may be sensitive to the costs of counter space used, and labor required in the sale and redemption of lottery tickets. Some lottery customers do not want to wait for a weekly or daily drawing. These customers may purchase "instant-win" lottery tickets. Such tickets may also involve games, such as poker, battleship, bingo, symbol matching, or other games that increase customer interest and enjoyment in the purchase of such tickets. Instant-win lottery tickets are generally sold to retailers in pre-printed books or bundles. Commonly, whether an instant-win ticket is a winner is predetermined prior to the sale of the ticket. Examples of instant win tickets are described in U.S. Pat. Nos. 6,250,685, 6,206,780, and 6,168,521.

Instant-win games differ from pooled drawing games, where a lottery ticket represents a chance in a drawing to be held at some later time for a pooled prize or prizes. Rather, in an instant-win game, whether the ticket is a winner may be pre-determined before or at the time the ticket is purchased, although whether a particular ticket is actually a winner may be concealed from the buyer and seller. Instant-win games may include "extended play" features such as games printed on the ticket, e.g., bingo or number matching. These features may increase the enjoyment and interest level of purchasers of such tickets, causing them to buy tickets in greater numbers or more frequently. These features may also include a "probability game" feature, where choices made by the player may impact whether the ticket is a winner or loser.

Often with instant-win tickets a customer may determine whether the instant-win ticket is a winning ticket based upon game play information displayed on the ticket. However, if the game play information does not result in a winning ticket then the customer may discard the ticket. Thus, once it is determined that the game play information displayed on a ticket does not result in a winning ticket that game play information is no longer of use to a customer.

Some instant-win tickets have been developed where a player may purchase additional game play information on a single ticket. For example, U.S. Pat. No. 5,996,997, to Kamille, discloses a single ticket wherein a customer may be able to purchase additional information on the ticket by scratching off a covering hiding additional information.

BRIEF DESCRIPTION OF THE DRAWINGS

FIG. 6 illustrates an example initial ticket log, according to an example embodiment of the present invention.

FIG. 7 illustrates an example second ticket log, according to an example embodiment of the present invention.

DETAILED DESCRIPTION OF EXAMPLE EMBODIMENTS

In an example embodiment of the present invention, a customer may purchase an initial ticket, such as an instant win ticket, which includes initial game play information. Based upon the initial game play information, the customer may determine whether the initial ticket is a winning ticket. The customer may then purchase additional game play information that may be combined with the initial game play information to provide the customer a second chance of winning or increased prize winnings. The additional game information may be provided, for example, as an addition to the initially purchased ticket, or separately as part of a second ticket or multiple additional tickets. In this regard, allowing a customer to purchase additional game play information that may be combined with the initial game play information may increase a customer's enjoyment of the game as well as result in more tickets being sold, and greater revenue per ticket.

The initial ticket may be a "scratch-off" or "peel-off" ticket having a removable coating intended to conceal the game play information prior to the purchase of the ticket. The format of the game play information may vary depending on the rules of the game. For example, if the game is a "prize-matching" game then the initial game play information may include an arranged sequence of dollar amounts where the appearance of three matching dollar amounts indicates a winning ticket redeemable for a prize equal to the dollar amounts matched. The game may also involve the option to purchase additional game play information, e.g., in the form of a second ticket that may be combined with the game play information of the initial ticket to increase the prize winnings of the initial winning ticket or to increase the chances of winning if the initial ticket is a non-winning ticket. The second ticket may or may not include a display of the initial game play information.

Example Initial Ticket for Playing a Game of Chance

Figure 1:
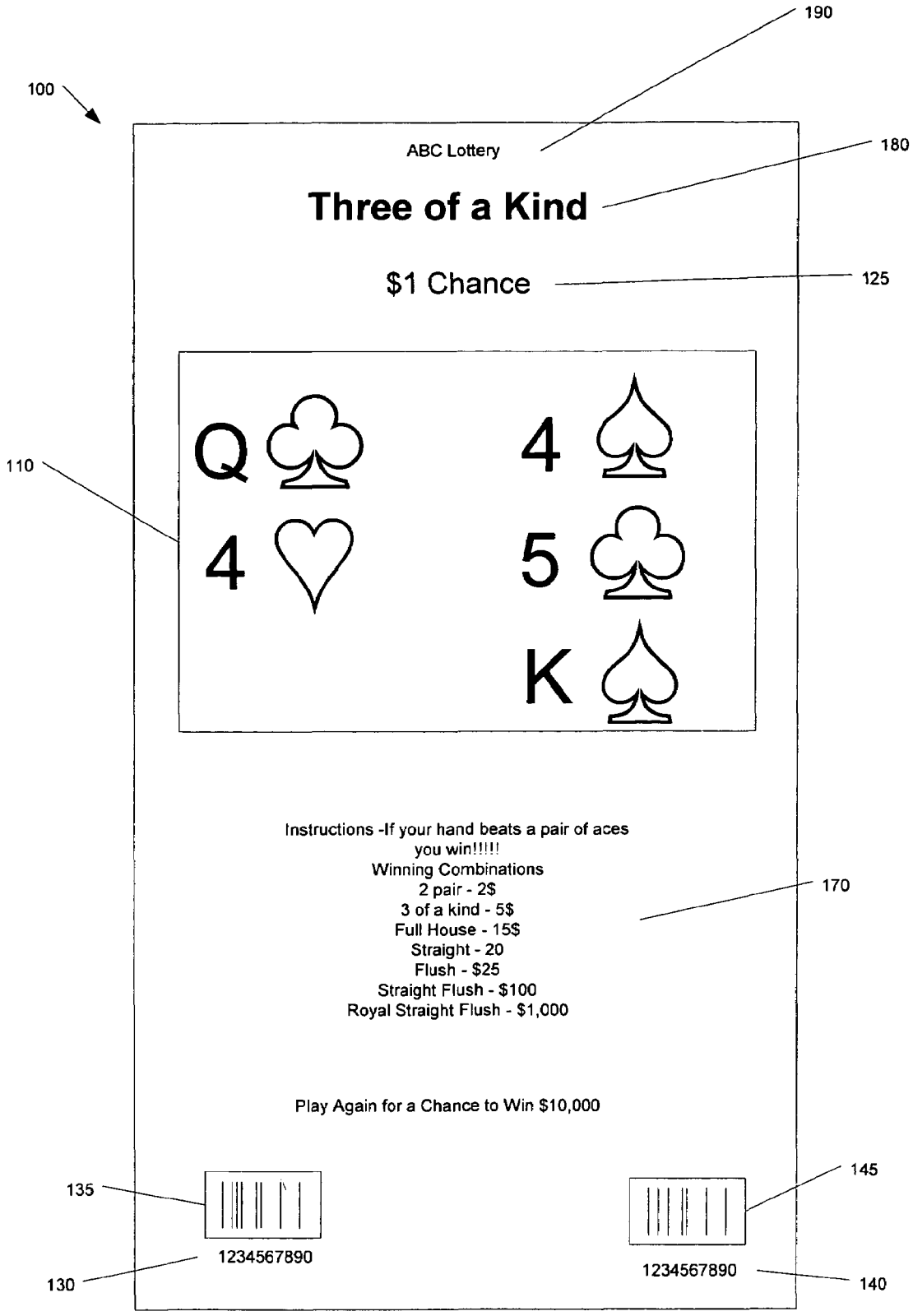
FIG. 1 illustrates an example initial ticket for a poker-type game, according to an example embodiment of the invention.

FIG. 1 illustrates an example initial ticket 100, according to an example embodiment of the present invention. The example initial ticket 100 may be an instant win ticket and may be received in a variety of ways, including, for example, by requesting a ticket from a cashier or establishment operator or by purchasing the ticket from a vending machine that distributes such tickets.

The example initial ticket 100 may be printed on a substrate, such as, for example, paper, card stock, plastic, or various laminates. Information may be found on both sides of the example initial ticket 100. Additionally, it will be appreciated that the example ticket 100 may alternatively be electronic or depicted on a display screen.

Example initial ticket 100 is for a poker type game. However, it will be appreciated that the example initial ticket may be configured for many other types of games, e.g., symbol matching, bingo, etc.

Example initial ticket 100 includes an initial game play information 110, an amount wagered field 120, an authentication code 130, a second chance code 140, game instructions 170, a display of the name of the game 180, and additional advertising information 190.

The initial game play information 110, which may be concealed at the time of purchase with a "peel-off" or "scratch-off" coating, allows the customer to determine whether the initial ticket is a winning ticket. In this instance, the initial game play information 110 includes five symbols representing five playing cards, namely, a 4♥ representing the "Four of Clubs", a 4♠ representing the "Four of Spades", a 5♣ representing the "Five of Clubs", a Q♣ representing the "Queen of Clubs", and a K♥ representing the "King of Hearts". It will be appreciated that the initial game play information may be of many types in addition to playing cards, e.g., dollar amounts, shapes, fruit, colors, depending on the rules of the game.

The amount wagered field 125 indicates, for example, the total purchase price paid for the example initial ticket 100.

The authentication code 130 uniquely identifies the ticket and may be represented, for example, by a sequence of numeric digits. More digits may be provided for greater security. The authentication code 130 may also include the information needed to authenticate the ticket when the ticket is redeemed. A machine-readable version of the authentication code 135 may also be located on the example initial ticket 100. The machine-readable version of the authentication code 135 may be a bar code, such as, for example, a stacked linear bar code or two-dimensional bar code. A standard I2 of 5 or other standard bar code may be employed. It will be appreciated that other forms of machine-readable information may be included on the ticket, in place of the bar codes, including, for example, magnetic strips or smart card capability. It will also be appreciated that the machine-readable code 135 may include other information, e.g., a checking code to provide sufficient information to identify whether the ticket is a winning ticket without providing sufficient information to authenticate the ticket. Such a checking code may be used at a checking station that may be provided to allow customers to verify whether they have winning tickets.

The second chance code 140 contains information needed in the event that a customer would like to purchase additional game play information, e.g. on a second ticket. It will be appreciated that the authentication code 130 and the machine-readable version of the authentication code 135 may include this information. A machine-readable version of the second chance code 145 may also be located on the example initial ticket 100. The machine-readable version of the second chance code 145 may be a bar code, e.g., a stacked linear bar code or two-dimensional bar code. A standard I2 of 5 or other standard bar code may be employed. It will be appreciated that other forms of machine-readable information may be included on the ticket, in place of the bar codes, e.g., magnetic strips or smart card capability.

The example initial ticket 100 may also include information not directly involved in the play of the game. For example, the initial ticket 100 may include instructions 170 for playing the game or for the use and/or redemption of the ticket. Additionally, the instructions 170 may include a chart indicating the prize received depending on the game play information and the rules of the game. In particular, the example chart may indicate what is required for a winning ticket and/or the corresponding prize amount for a particular sequence/occurrence of game play information.

It will be appreciated that other information may be included in the example initial ticket, such as, the name of the game 180, additional advertising information 190, coupons, etc. Legal disclaimers or the rules of the game may be printed on the ticket, e.g., on the reverse side. Additional security and authentication information may also be added, e.g., multiple layers, special marks, etc.

Example Second Ticket for Playing a Game of Chance

Figure 2:
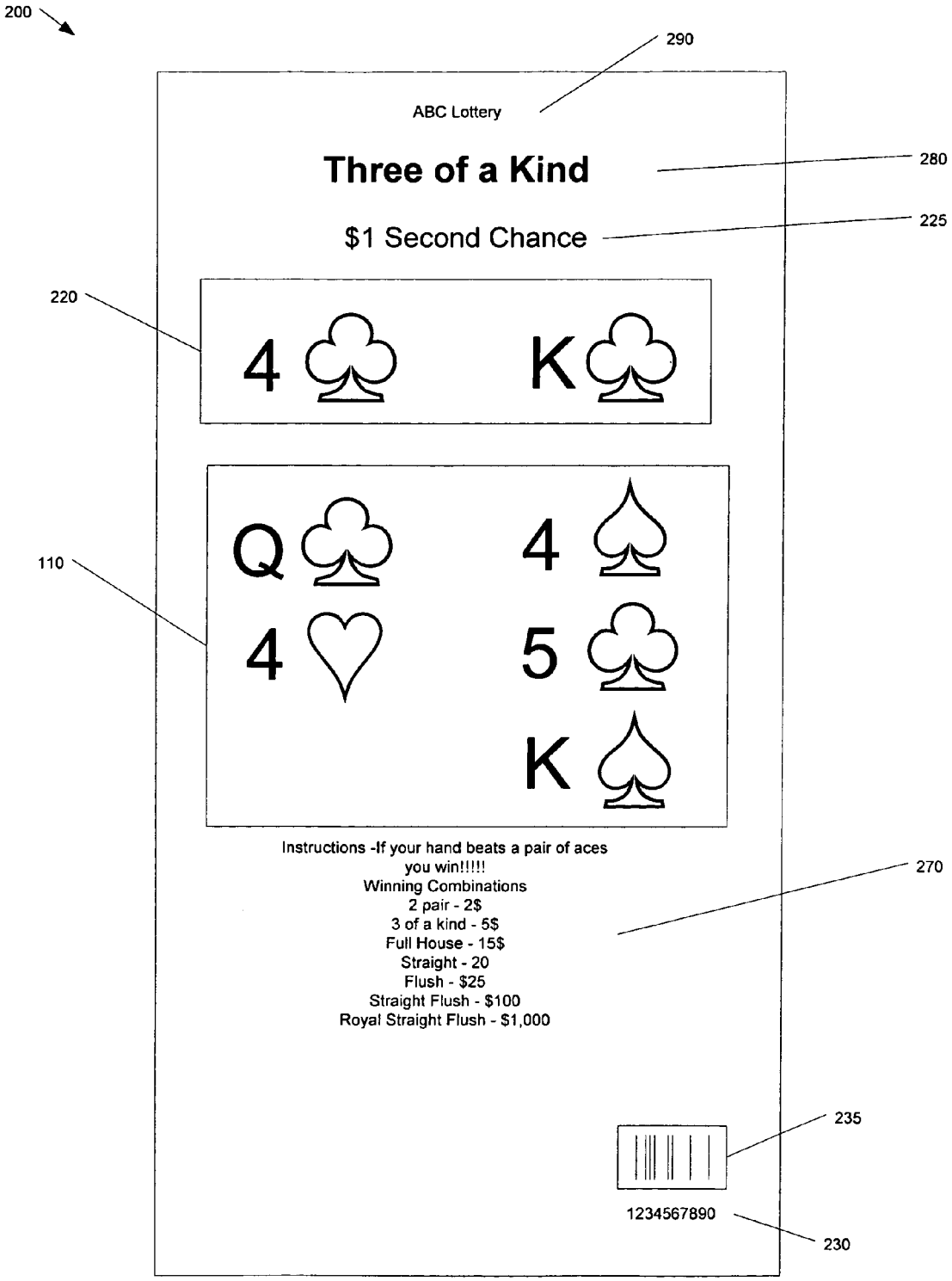
FIG. 2 illustrates an example second ticket for a poker-type game, according to an example embodiment of the invention.

FIG. 2 represents an example second ticket 200, according to an example embodiment of the present invention. The example second ticket 200 may be received in a variety of ways, such as, for example, by handing a cashier an initial ticket and requesting a second ticket or by purchasing a second ticket from a vending machine that generates such tickets. It is intended that the example second ticket 200 be purchased after the purchase of the initial ticket. In this regard, the example second ticket 200 may provide a customer with a second chance at winning or increased prize winnings based in part on the game play information displayed on an initial ticket.

The example second ticket 200 may be printed on a substrate, e.g., a printable substrate such as paper, card stock, plastic, or various laminates. Additionally, it will be appreciated that the example second ticket 200 may be electronic or depicted on a display screen. Information may be found on both sides of the example second ticket 200.

Example second ticket 200 is for a poker type game. However, it will be appreciated that the example second ticket may be configured for many other types of games, e.g., symbol matching, bingo, etc.

The example second ticket 200 includes additional game play information 220, initial game play information 110, an amount wager field 225, an authentication code 230, game instructions 270, a game name 280, and advertising information 290.

The initial game play information 110 includes five playing cards, namely a 4♣ representing the "Four of Hearts", a 4♣ representing the "Four of Spades", a 5♠ representing the "Five of Clubs", a Q♠ representing the "Queen of Clubs", and a K♣ representing the "King of Hearts". It will be appreciated that the initial game play information may be of many types in addition to playing cards, e.g., dollar amounts, shapes, fruit, colors. It will also be appreciated that since the initial game play information 110 may be displayed on the initial ticket, the customer may already know of the initial game play information prior to receipt of the second ticket. Accordingly, it will be appreciated that the initial game play information may or may not be displayed on example second ticket 200. For example, the initial game play information may be printed on a second ticket or, alternatively, the initial game play information may be printed on the initial ticket at a time after its initial purchase.

The additional game play information 220 includes two additional playing cards, namely, a 4♠ "Four of Clubs" and a K♠ "King of Clubs". It will be appreciated that the additional game play information may be of many types in addition to playing cards, e.g., dollar amounts, shapes, fruit, colors. However, although not required, the additional game play information should be of the same type as the initial game play information.

The combination of the initial game play information 110 and the additional game play information 220 determines whether the second ticket is a winning ticket. It will be appreciated that depending on the rules of the game more or less additional game play information may be purchased. For example, one, two, or three additional cards may be purchased either all together, or in sequence.

The amount wagered field 225 indicates, for example, the total purchase price paid for the example second ticket 200.

The authentication code 230 uniquely identifies the ticket and may be represented, for example, by a sequence of digits. More digits may be provided for greater security. The authentication code 230 may include the information needed to authenticate the ticket when the ticket is redeemed. A machine-readable version of the authentication code 235 may also be located on the example ticket 200. The machine-readable version of the authentication code 235 may be a bar code, e.g., a stacked linear bar code or two-dimensional bar code. A standard I2 of 5 or other standard bar code may be employed. It will be appreciated that other forms of machine-readable information may be included on the ticket, in place of the bar codes, e.g., magnetic strips or smart card capability. It will also be appreciated that the machine-readable code 230 may also include other information, e.g., a checking code that may provide sufficient information to identify whether the ticket is a winning ticket without providing sufficient information to authenticate the ticket. Such a checking code may be used at a checking station that may be provided to allow customers to test whether they have winning tickets.

The example second ticket 200 may also include information not directly involved in the play of the game. For example, second ticket 200 may include instructions 270 for playing the game or for the use and/or redemption of the ticket. Additionally, the instructions 270 may include a chart indicating the prize winnings to be received depending on the game play information and the rules of the game. It should be noted that the rules of the game may or may not be the same on the example second ticket as they were on the initial ticket.

It will be appreciated that other information may be included in the example second ticket, e.g., the name of the game 280, additional advertising information 290, coupons, etc. Rules of the game and/or legal disclaimers may be printed on the ticket, e.g., on the reverse side. Additional security and authentication information may also be added, e.g., multiple layers, special marks, etc.

Another Example Initial Ticket for Playing a Game of Chance

Figure 3A:
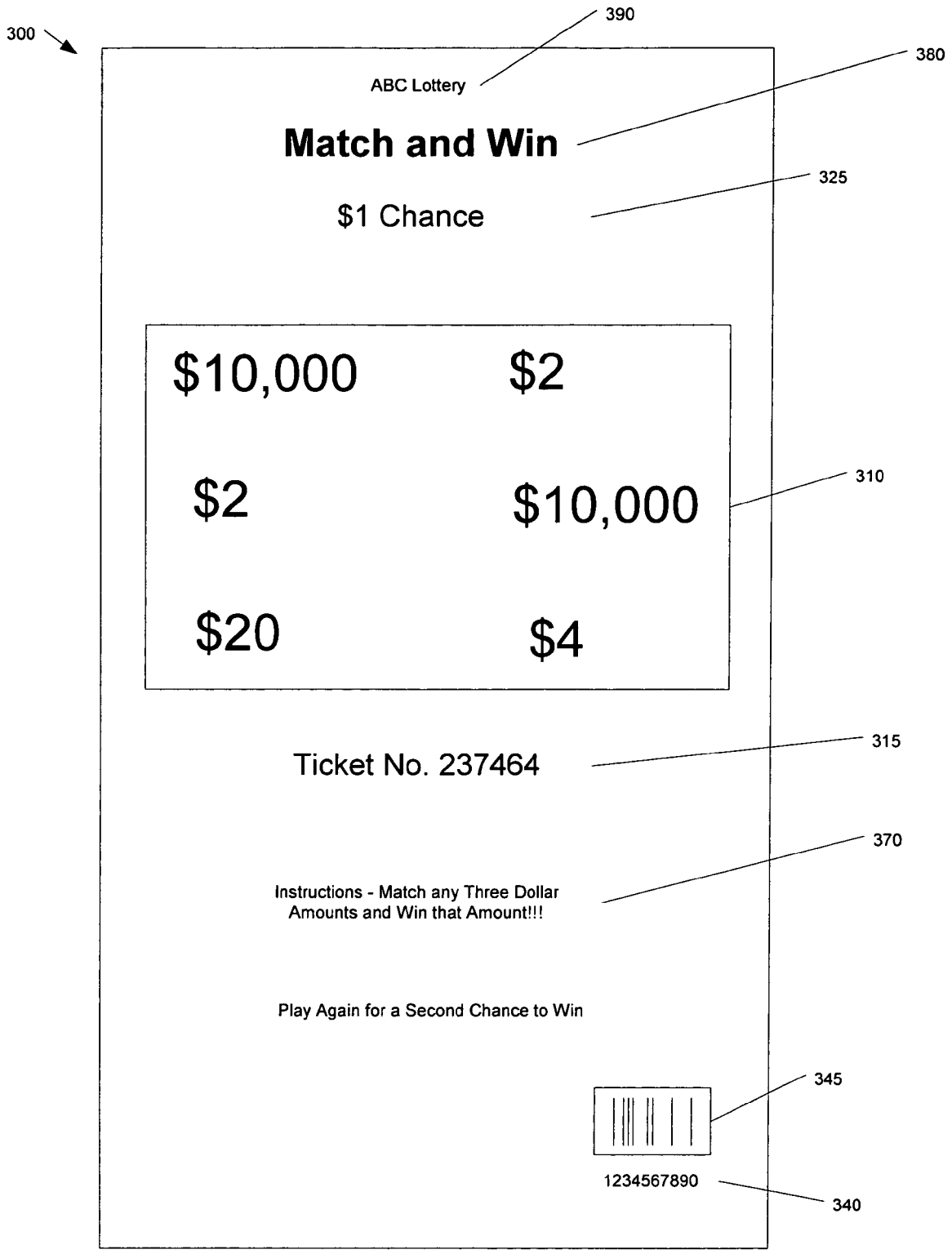
FIG. 3A illustrates an example initial ticket for a dollar-matching game, according to an example embodiment of the present invention.

FIG. 3A illustrates an example initial ticket 300, according to an example embodiment of the present invention. The example initial ticket 300 may be an instant win ticket and may be received in a variety of ways, including, for example, by requesting a ticket from a cashier or establishment operator or by purchasing the ticket from a vending machine that distributes such tickets.

The example initial ticket 300 may be printed on a substrate, such as, for example paper, card stock, plastic, or various laminates. Additionally, it will be appreciated that the example initial ticket may be electronic or depicted on a display screen. Information may be found on both sides of the example initial ticket 300.

Example initial ticket 300 is intended for a dollar matching game. However, it will be appreciated that the example initial ticket 300 may be configured for many other types of games, including, for example, symbol matching, bingo, and poker games.

The example initial ticket 300 includes initial game play information 310, a ticket number 315, an amount wager field 325, an authentication code 330, game instructions 370, a game name 380, and advertising information 390.

The initial game play information 310 includes information to determine whether the initial ticket 300 is a winning ticket. Here in FIG. 3A, the initial game play information 310 includes six dollar amounts, namely, $10,000, $2, $20, $2, $10,000, and $4. If the rules require that three dollar amounts be matched for the ticket to be a winning ticket then this example initial ticket 300 is not a winning ticket. However, the customer may have the option to purchase a second ticket with additional game play information that may be combined with the game play information of the initial ticket.

It will further be appreciated that the game information may be represented in forms other than or in addition to dollar amounts, including, for example, playing cards, shapes, fruit, colors, etc.

Another Example Second Ticket for Playing a Game of Chance

Figure 3B:
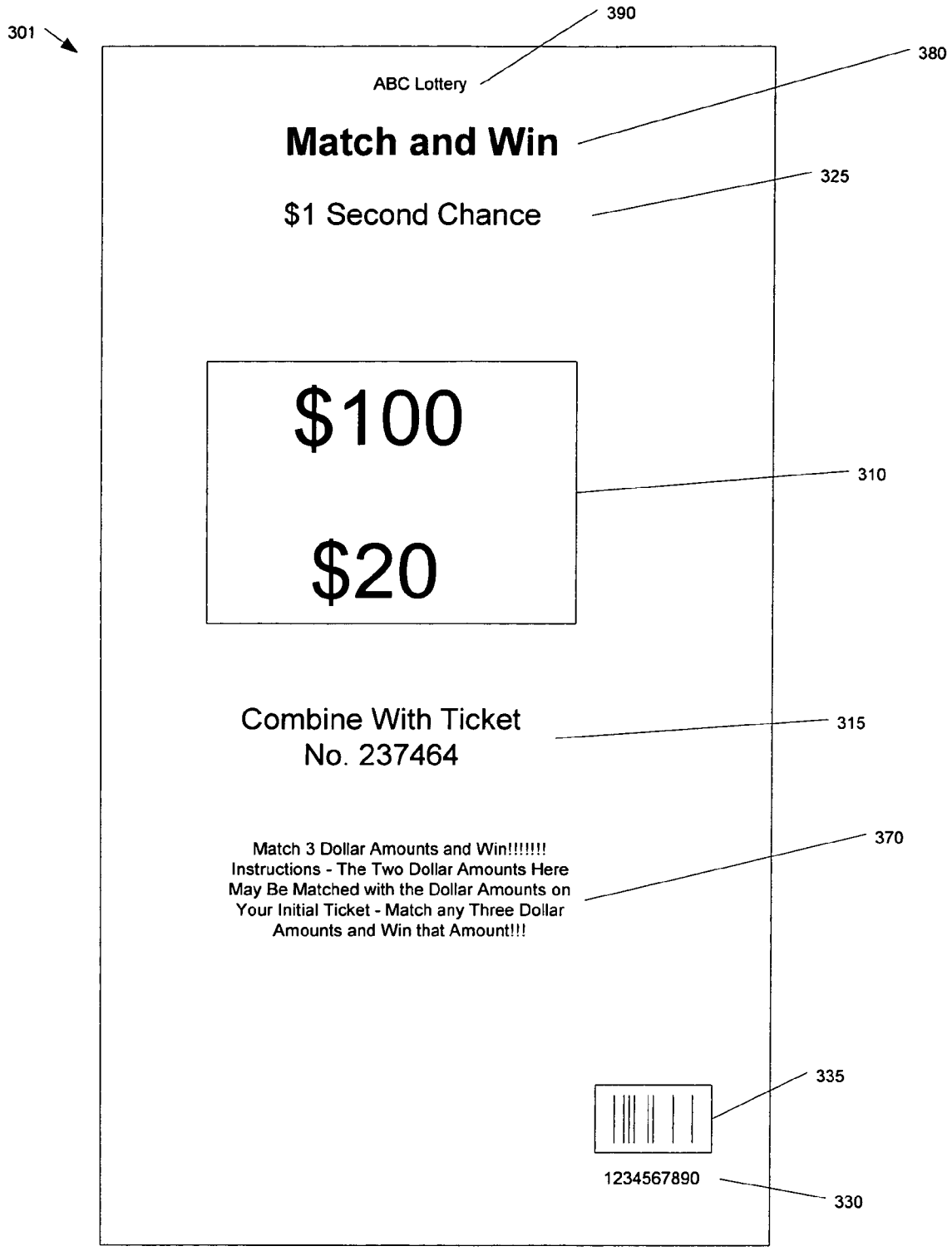
FIG. 3B illustrates an example second ticket for a dollar-matching game, according to an example embodiment of the invention.

FIG. 3B represents another example second ticket 301, according to an example embodiment of the present invention. The example second ticket 301 may be received in a variety of ways, e.g., by requesting a ticket from a cashier or establishment operator or by purchasing a ticket from a vending machine that generates such tickets. It is intended that the example second ticket 301 be purchased after the purchase of the initial ticket 300. In this regard, the example second ticket 301 may provide a customer with a second chance to win a prize or increase the amount of prize winnings.

The example second ticket 301 may be for an instant win game and may be printed on a substrate, e.g., a printable substrate such as paper, card stock, plastic, or various laminates. Additionally, it will be appreciated that the example second ticket 301 may be electronic or depicted on a display screen. Information may be found on both sides of the example second ticket 301.

Example second ticket 301 is intended for a dollar matching game. However, it will be appreciated that the example second ticket 301 may be configured for many other types of games, e.g., symbol matching, bingo, poker, etc.

The example second ticket 301 includes additional game play information 310, an initial ticket number 315, an amount wager field 320, an authentication code 330, game instructions 370, a game name 380, and advertising information 390.

The additional game play information 320 includes information that is intended to be combined the initial game play information 310 of the example initial ticket 300 of FIG. 3A. Thus, the combination of the initial game play information of the initial example ticket 300 and the additional game play information 310 determines whether the second ticket 301 is a winning ticket. Here in FIG. 3B, the additional game play information 320 includes two dollar amounts, namely \$10 and \$20. Therefore, in this instance, the combination of initial game play information 310 and additional game play information 320 produces three \$20 and the second ticket may therefore be a winning ticket. Although, in the above description the second ticket 301 is described as only containing the additional game play information it will be appreciated that the initial and additional game play information may both be displayed on the second ticket.

It will be appreciated that the additional game play information may be of many types in addition to dollar amounts, e.g., symbols, shapes, fruit, colors, etc.

The initial ticket identification field 315 allows a purchaser of the example second ticket 301 to identify the corresponding initial ticket 300 whose initial game play information is to be combined with the additional game play information 320 of the second ticket 301.

The amount wagered field 325 indicates, for example, the total purchase price paid for the example second ticket 301.

The authentication code 330 uniquely identifies the ticket and may be represented by a sequence of digits. More digits may be provided for greater security. The authentication code 330 may include the information needed to authenticate the ticket when the ticket is redeemed. A machine-readable version of the authentication code 335 may also be located on the example second ticket 301. The machine-readable version of the authentication code 340 may be a bar code, e.g., a stacked linear bar code or two-dimensional bar code. A standard I2 of 5 or other standard bar code may be employed. It will be appreciated that other forms of machine-readable information may be included on the ticket, in place of the bar codes, e.g., magnetic strips or smart card capability. It will also be appreciated that the machine-readable code 335 may also include other information, e.g., a checking code that may provide sufficient information to identify whether the ticket is a winning ticket without providing sufficient information to authenticate the ticket. Such a checking code may be used at a checking station that may be provided to allow customers to test whether they have winning tickets.

The second example second ticket 301 may also include information not directly involved in the play of the game. For example, second ticket 301 may include instructions 370 for playing the game or for the use and/or redemption of the ticket. The instructions 370 may also include a chart indicating the prize received depending on the game play information and the rules of the game. The chart may indicate, for example, the game play information necessary to make the ticket a winning ticket. The chart may also include the prize for certain game play information.

It will be appreciated that other information may be included on the second example second ticket, e.g., the name of the game 380, additional advertising information 390, coupons, etc. Rules of the game and/or legal disclaimers may be printed on the ticket, e.g., on the reverse side. Additional security and authentication information may also be added, e.g., multiple layers, special marks, etc.

Additionally, although the same game rules may be applied to both the initial ticket and the second ticket, namely three matches are required to make a ticket a winning ticket, it will be appreciated that the rules of the game may change for the second ticket, i.e., four matches may be required to make a ticket a winning ticket.

Example Procedure for Playing a Game of Chance

Figure 4:
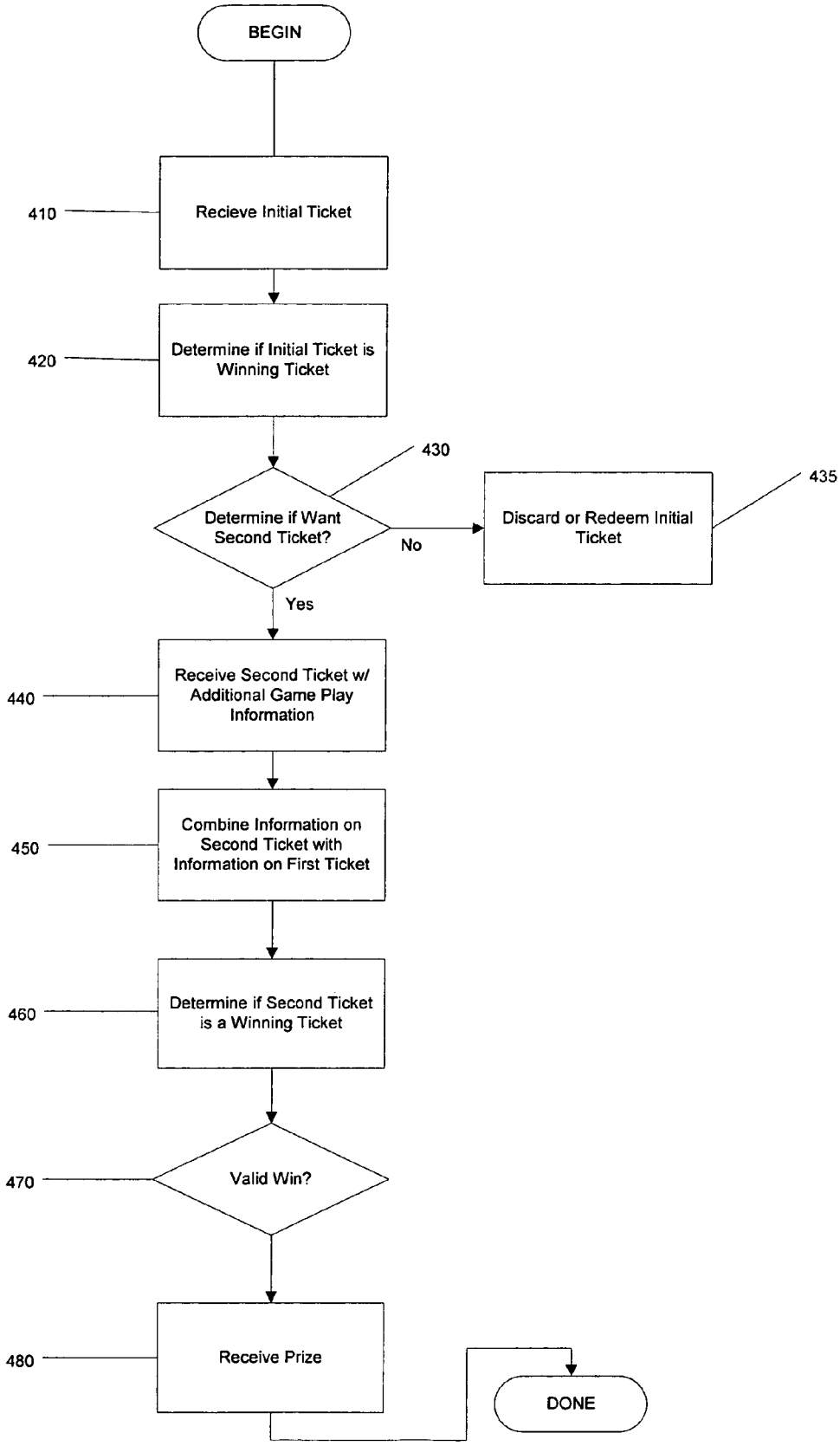
FIG. 4 illustrates an example procedure for playing a game of chance, according to an example embodiment of the present invention.

FIG. 4 illustrates an example procedure for playing a game of chance, according to an example embodiment of the present invention. In 410, a customer receives an initial ticket for a game of chance. The initial ticket may be received in a variety of ways, e.g., by requesting a ticket from a cashier or establishment operator or by purchasing a ticket from a vending machine that distributes such tickets. The initial ticket may be an instant win ticket providing the customer with at least one chance to win the game.

In 420, a customer may examine the game play information of the initial ticket to determine whether the initial ticket is a winning ticket. In this regard, the customer may be required to remove a "scratch-off" layer concealing the game play information. Whether the initial ticket is a winning ticket may vary depending on the particular rules of the game being played. For example, the rules may require that the initial game play information include a matching sequence of symbols. In this regard, it will be appreciated that many types of games may be foreseen, including, for example, poker type games, dollar amount matching games, bingo, etc.

In 430, a customer may determine whether they would like to acquire a second ticket with additional game play information. In the event that the customer chooses not to acquire a second ticket with additional game play information then, in 435, the customer may redeem the initial ticket for a prize, if the initial ticket is a winning ticket, or discard the ticket, if the initial ticket is not a winning ticket, as with a conventional instant win ticket. It will be appreciated that depending on the rules of the game a customer may or may not be able to acquire a second ticket with additional game play information if the first ticket is a winning ticket.

In the event that the customer decides that they would like a second ticket containing additional game play information then the customer may purchase a second ticket. In 440, a customer receives a second ticket containing additional game play information. The second ticket containing additional game play information may be received in a variety of ways, e.g., by tendering an initial ticket and requesting a second ticket from a cashier or establishment operator or by purchasing a second ticket from a vending machine that generates such tickets. A second chance code that uniquely identifies the initial ticket may be used by the cashier or vending machine for the generation of a second ticket. The additional game play information provides the customer with a different chance in the game dependent in part on the initial game play information contained on the first ticket.

In 450, the customer may combine the initial game play information with the additional game play information. For example, if a customer receives the example second ticket depicted in FIG. 2, then the customer's card hand would be the seven playing card symbols depicted on FIG. 2—that is, the combination of the initial game play information and the additional game play information.

In 460, a customer may determine whether the second ticket is a winning ticket. The determination may be made based on the combination of the initial game play information and the additional game play information. Whether a ticket is a winning ticket may vary depending on the particular rules of the game being played. For example, the second ticket depicted in FIG. 2, requires a playing card hand greater than a pair of aces for the second ticket to be a winning ticket. It will be appreciated that the initial ticket and the second ticket may be configured for many types of games, e.g., poker type, symbol matching, bingo, etc.

In 470, a customer presents a winning ticket for redemption, e.g., by presenting it to the cashier or placing it in a ticket validator. The gaming procedure may require tickets to be redeemed at the same establishment where they are sold, or may allow ticket to be redeemed at a future time and at various locations. The ticket may be authenticated to determine whether the ticket is actually a valid winning ticket, e.g., if the ticket is a winning ticket and has not previously been redeemed. The authentication may be done by use of an authentication code that uniquely identifies the ticket. Conventional schemes for authenticating ticket numbers may be employed, e.g., the authentication number may be used as part of a public key encryption system. The authentication may be done by first ensuring that the ticket is a winning ticket.

In 480, if the ticket is valid winning ticket, a customer may receive a prize for the winning ticket. The prize may be anything of value including additional tickets.

Example Procedure for Facilitating the Play of a Game of Chance

Figure 5:
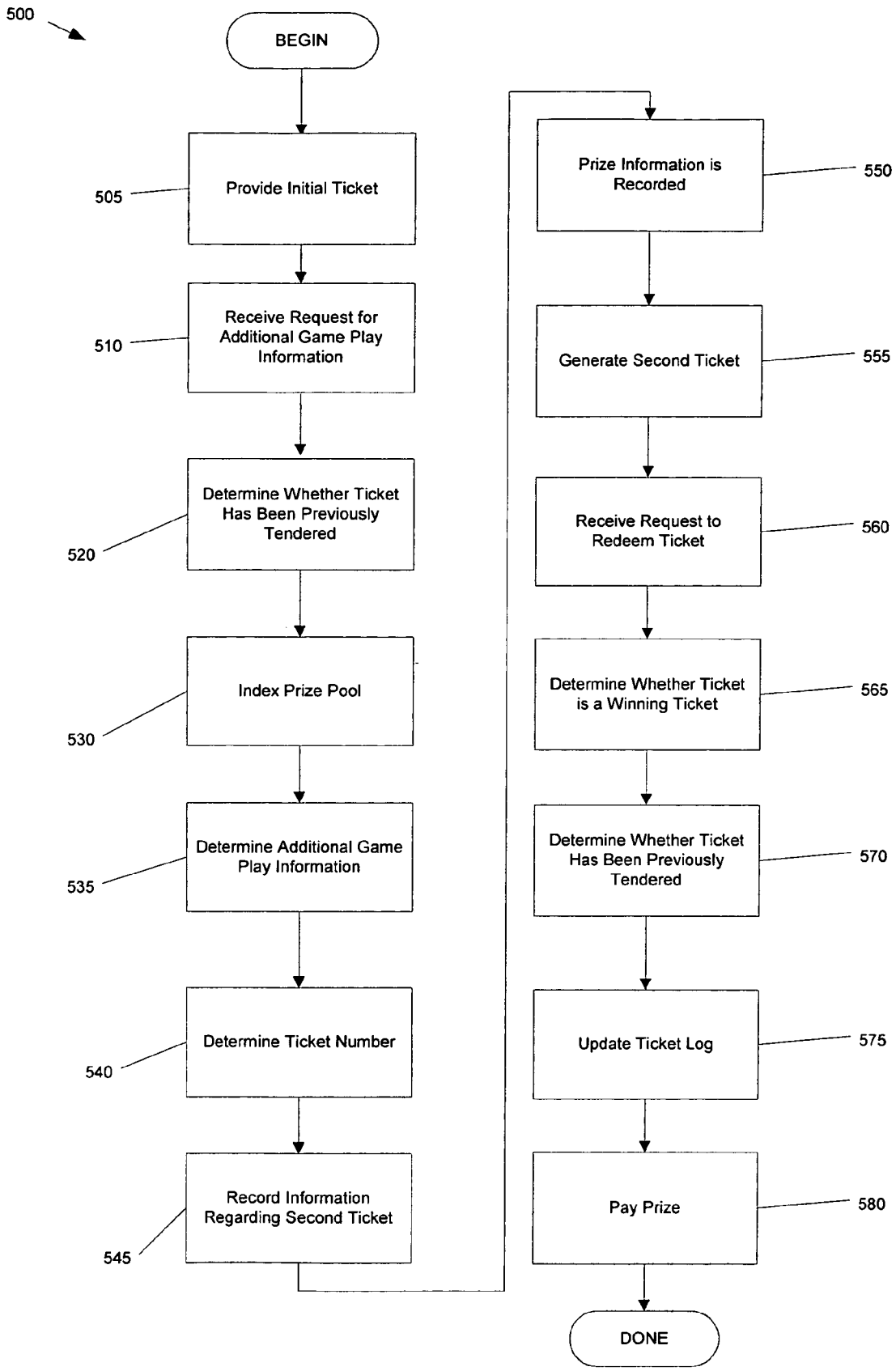
FIG. 5 illustrates an example procedure for facilitating the play of a game of chance, according to an example embodiment of the present invention.

FIG. 5 illustrates an example method 500 for facilitating the play of a game of chance, according to an example embodiment of the present invention. In 505, an initial ticket is provided to a customer by a cashier or attendant, or via an automated ticket point of sale system. It will be appreciated that a customer may be anyone who receives an initial ticket. Additionally, it will be appreciated that the initial ticket may be an electronic ticket.

In 510, a request for additional game play information may be received. This request may be received by a cashier or attendant, or via an automated point of sale system.

In 520, whether the initial ticket has been previously tendered for additional game play information is determined. In this regard, for example, a second chance code on the initial ticket may be scanned and/or a ticket log may be examined to verify that the additional game play information has not been previously purchased for the initial ticket. In the event that the ticket log indicates that additional game play information was previously tendered for the initial ticket a message may be sent to the operator indicating that a second ticket should not be sold. The ticket log when indexed may include the initial game play information displayed on the initial ticket. It will be appreciated that a game may be played such that a customer may purchase multiple second tickets for a single initial ticket.

In 530, a prize pool is indexed to determine a prize associated with the second ticket. The prize pool once indexed generates an entry, which includes information regarding whether the chance associated with the second ticket is a winning ticket. If the generated entry is "used" then the prize pool is indexed until an "unused" entry is located. An entry includes information regarding whether the chance associated with the second ticket is a winning chance, and thus whether a ticket is a winning ticket. If when indexed the prize is determined to be 0 then the chance associated with the second ticket may not be a winning chance.

In 535, the additional game play information to be displayed on the second ticket is determined. In this regard, a program may be used to generate the additional game play information that creates the prize indexed in the prize pool. For example, by scanning a second chance code on the initial ticket and examining a ticket log the initial game play information may be determined. The program may use this information to determine the additional game play information that results in an appropriate prize such as a particular dollar amount. For example, if the prize is determined to be $5 in step 530 then a program may determine the required additional game play information that when combined with the initial game play information results in a winning chance that pays a prize of $5.

In 540, a ticket number is generated for the second ticket, which uniquely identifies the ticket. The ticket number may be the authentication number.

In 545, the ticket information is recorded. This information may include the initial game play information, the additional game play information now displayed on the second ticket, and the prize that was indexed in the prize pool.

In 550, the prize information is recorded. This may include marking the currently indexed entry of the prize pool as "used".

In 555, the ticket is generated. In this regard, the ticket may be generated by printing the ticket. The ticket may include a set of symbols, an authentication code, a time/date field, a games played field, or game instructions. Additionally, the second ticket may be generated electronically in the case of an electronic ticket.

In 560, a request to redeem a ticket may be received. The ticket may be tendered, e.g., by turning it in to a cashier or attendant, or via an automated point of sale system by inserting it into an automatic reader.

In 565, whether a ticket is a winning ticket may be verified. This information may be determined by looking up the authentication code or other information uniquely identifying the ticket in a ticket log that includes information regarding previous sold tickets.

In 570, whether the tendered ticket has been previously tendered may be determined. For example, a ticket log may be examined to verify that the tendered ticket has not been previously redeemed. In the event that the ticket log indicates that the ticket has been previously redeemed a message may be sent to the operator indicating that the ticket has been redeemed.

In 575, the ticket log may be updated to reflect that the tendered ticket has been tendered for redemption. In this regard, the same ticket may be prevented from being redeemed a second time at a later date.

In 580, an indication may be provided directed the cashier to redeem the tendered ticket, e.g., by displaying a prompt on a redemption system display. The amount to be paid may be displayed to the cashier, and/or directly to the person redeeming the ticket. This indication may indicate both that the ticket should be redeemed and the amount for redemption. Alternatively, in an automated system, the ticket authentication procedure may initiate a ticket payment procedure automatically, once the ticket has been validated. The information regarding the ticket information may be read from a ticket log.

It will be appreciated that other actions may be included in the example procedure for authentication and payment. For example, electronic payment may require different procedures. Extra security measures may be provided for large prizes, or old tickets, or tickets that were sold at different establishments than the one redeeming the ticket.

Example Initial Ticket Log

FIG. 6 illustrates an example initial ticket log 600, according to an example embodiment of the present invention. The example ticket log 600 may be used to keep track of initial tickets in terms of whether they have been purchased or not, as well as whether the initial tickets have been redeemed. Additionally, the example ticket log 600 may keep track of whether additional game play information has been sold for an initial ticket and/or may assist in generating the additional game play information. The example ticket log 600 may include entries 610, each corresponding to a ticket that has been sold. It will be appreciated that the ticket log 600, although illustrated as a table, may be implemented in a variety of conventional data structures, e.g., as a linked list, or a custom-designed object. It will also be appreciated that the initial ticket log information may be incorporated in other data structures, rather than as a separate log, e.g., if the prize pool were stored in a relational database, the information may be stored in the prize pool may be split in multiple tables in a manner that allows the information to be accessed as a log using conventional database queries. Additionally, it will be appreciated that the initial ticket log information may be combined with ticket log information regarding non-initial tickets to form, for example, a generic and/or combined ticket log.

FIG. 6*b* illustrates an example entry 610 from the example initial ticket log 600, according to an example embodiment of the present invention. The example entry 610 includes information about a particular ticket. In particular, the example entry 610 includes a ticket number 660, a second chance field 650, a game information field 620, a prize amount field 630, and a redeemed indication field 640.

The ticket number 660 uniquely identifies a ticket that has been sold and may be implemented, for example, as an authentication code.

The game play information field 620 indicates the initial game play information displayed on the initial ticket. In this instance, the initial game play information field indicates that the numbers 1, 3, 7, and 8 are displayed as the initial game play information on the initial ticket. In this regard, the initial ticket may be for a number type matching game.

The prize amount field 630 indicates the amount to be paid upon redemption of the initial ticket. This amount may be calculated based on the initial game play information.

The redemption indication field 640 indicates whether the ticket has been redeemed. Optionally, the redemption indication field 640 may also indicate when and where the redemption occurred.

The example entry 610 may include a second chance field 650 to indicate whether the customer has purchased additional game play information for the particular ticket. It will be appreciated that the second chance field 650 may be combined with the redeemed indication field 640. Thus, this field may be used to indicate whether an initial ticket has been redeemed and whether additional game play information has been purchased for a particular ticket.

It will be appreciated that the ticket log entry may include other fields not shown, e.g., an indication where or by whom the ticket was sold or redeemed, the value of the authentication code for the ticket, price information for the ticket, an indication of the symbols to be displayed for that game.

Example Second Ticket Log

FIG. 7 illustrates an example second ticket log 700, according to an example embodiment of the present invention. The example second ticket log 700 may be used to keep track of second tickets that contain additional game play information, as well as whether second tickets have been redeemed. The example second ticket log 700 includes entries 710, each corresponding to a second ticket that has been sold. It will be appreciated that the example second ticket log 700, although illustrated as a table, may be implemented in a variety of conventional data structures, e.g., as a linked list, or a custom-designed object. It will also be appreciated that the information contained in the second ticket log may be incorporated in other data structures, rather than as a separate log. For example, if the prize pool were stored in a relational database, the information stored in the prize pool may be split in multiple tables in a manner that allows the information to be accessed as a log using conventional database queries. Additionally, it will be appreciated that the example second ticket log 700 may be combined with an initial ticket log to form a single ticket log.

FIG. 7*b* illustrates an example entry 710 from the example second ticket log 700, according to an example embodiment of the present invention. The example entry 710 includes information about a particular second ticket. In particular, the example entry 710 includes a ticket number 750, a game play information field 720, a prize amount field 730, and a redemption field 740.

The ticket number 750 uniquely identifies a second ticket that has been sold. The ticket number 750 may be an authentication code.

The game play information field 720 indicates the game play information displayed on the second ticket, which may include both the initial game play information and the additional game play information.

The prize amount field 730 indicates the amount that will be paid upon redemption of the second ticket.

The redemption field 740 indicates whether the ticket has been redeemed, and if it has when the redemption occurred.

It will be appreciated that the ticket log entry may include other fields not shown, including, for example, an indication where or by whom the ticket was sold or redeemed, the value of the authentication code for the ticket, price information for the ticket, an indication of the symbols to be displayed for that game.

Example Prize Pool

According to an example embodiment of the present invention, a prize pool may be used to determine the winnings available and/or collected during game play. In this manner, the amount and percentage of prizes paid may be determined at the time of the sale of the second ticket. Thus, it may be determined whether a second ticket is a winning ticket at the time of the sale of the ticket. Although, whether a second ticket is a winning ticket may not be apparent to a customer until after the customer reviews the information contained on the ticket.

Figure 8:
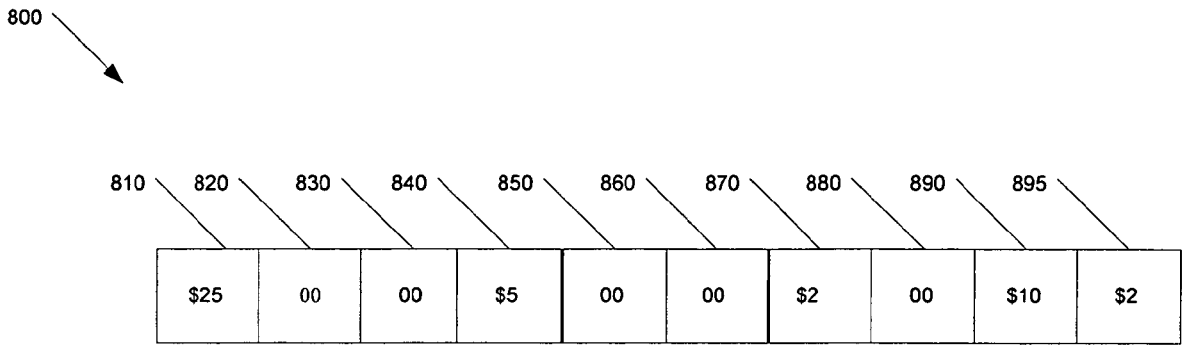
FIG. 8 illustrates an example prize pool, according to an example embodiment of the present invention.

FIG. 8 illustrates an example prize pool 800, according to an example embodiment of the present invention. Although the example prize pool 800 is illustrated as a table or array of values, it will be appreciated that other conventional data structures may be employed, including, for example, a relational database, a linked list, a tree, a programmer defined object, etc. The example prize pool 800 may include entries 810, 820, 830, 840, 850, 860, 870, 880, 890 and 895, each corresponding to a second ticket that may be sold to a customer.

The example prize pool 800 of FIG. 8 contains ten entries. To index the entries, a random number between one and ten may be generated. If the random number generated is four, for example, then the fourth entry may be indexed. Here, the fourth entry 840 indicates that the second ticket should result in a winning ticket with a value of $5. A set of additional game play information may then be generated on a second ticket to indicate to the customer that this information when combined with the initial game play information results in a winning ticket with a prize of $5. After an entry is indexed it may be deleted from the prize pool. For example, where the fourth entry is indexed, this entry may be deleted leaving only nine entries to index for subsequent use.

It will be appreciated that, by varying the size and composition of the prize pool, the properties of the game may be varied. For example, increasing the number of winning entries in the prize pool may increase the average probability that a chance in a game is a winning chance. Moreover, having more or fewer large prizes may also vary the game.

Second Example Prize Pool

According to an example embodiment of the present invention, a prize pool may be used to facilitate in determining the winnings available and/or collected during game play. In this manner, the expected number and amount of prizes to be paid may be determined when the second tickets are sold (e.g., time of purchase). Each time a second ticket is requested, the prize pool may be indexed to determine whether the second ticket should be a winning ticket. Although, whether a ticket is a winning ticket may not be apparent to a customer.

Figure 9A:
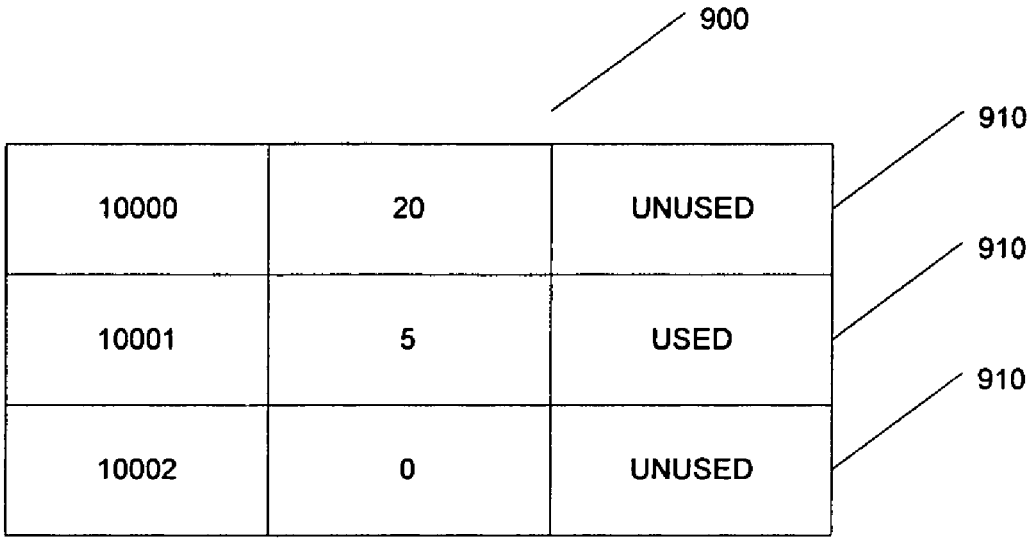
FIG. 9 illustrates a second example prize pool, according to an example embodiment of the present invention.

FIG. 9*a* illustrates a second example prize pool 900, according to an example embodiment of the present invention. Although the second example prize pool 900 is illustrated as a table or array, it will be appreciated that other conventional data structures may be employed, including, for example, a relational database, a linked list, a tree, a programmer defined object, etc. The second example prize pool 900 may include entries 910, each corresponding to a second ticket sold to a customer.

Figure 9B:
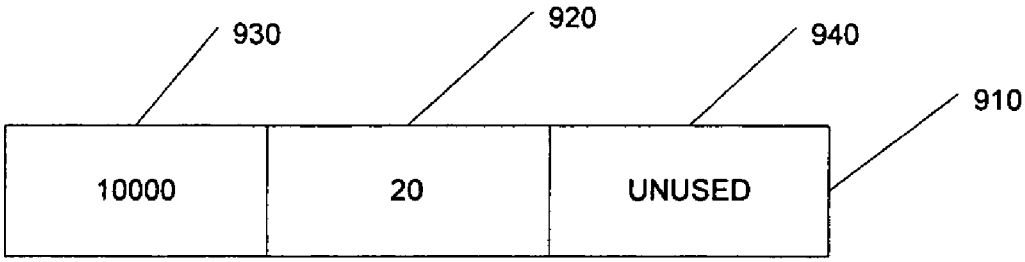

FIG. 9*b* illustrates an example entry 910 from the example prize pool 900, according to an example embodiment of the present invention. The example entry 910 includes information regarding second tickets sold to a customer. In particular, example entry 910 includes an index number field 930, an amount field 920, and a "used" field 940.

The index number field 930 identifies a particular second ticket.

The amount field 920 indicates the base amount to be won by the second ticket. When a winning second ticket is redeemed this amount may be awarded based upon this ticket. In the event that the amount field is 0, then the additional game play information generated on a second ticket will not result in a winning ticket. In the event that the amount field is an amount other than 0 then the additional game play information when combined with the initial game play information may result in a winning ticket paying a prize of this amount.

The "used" field 940 indicates whether a particular second ticket has been sold or not. In the event that an entry is randomly indexed and the used field 940 indicates that the entry has been used, the prize pool may be randomly indexed for another entry.

It will also be appreciated that many different data structures may be used to implement a prize pool entry. For example, the entry may be implemented as a linked list entry, or the information contained therein may be spread over multiple tables in a relational database with a common index.

It will further be appreciated that, by varying the size and composition of the prize pool, the properties of the game may be varied. For example, increasing the number of winning entries in the prize pool may increase the average probability that a chance in a game is a winning chance. Moreover, having more or fewer large prizes may also vary the game. Likewise, the potential number of additionally purchased tickets may be configured so that, for example, additional chances to win may be provided.

Example Lottery Terminal System

Figure 10:
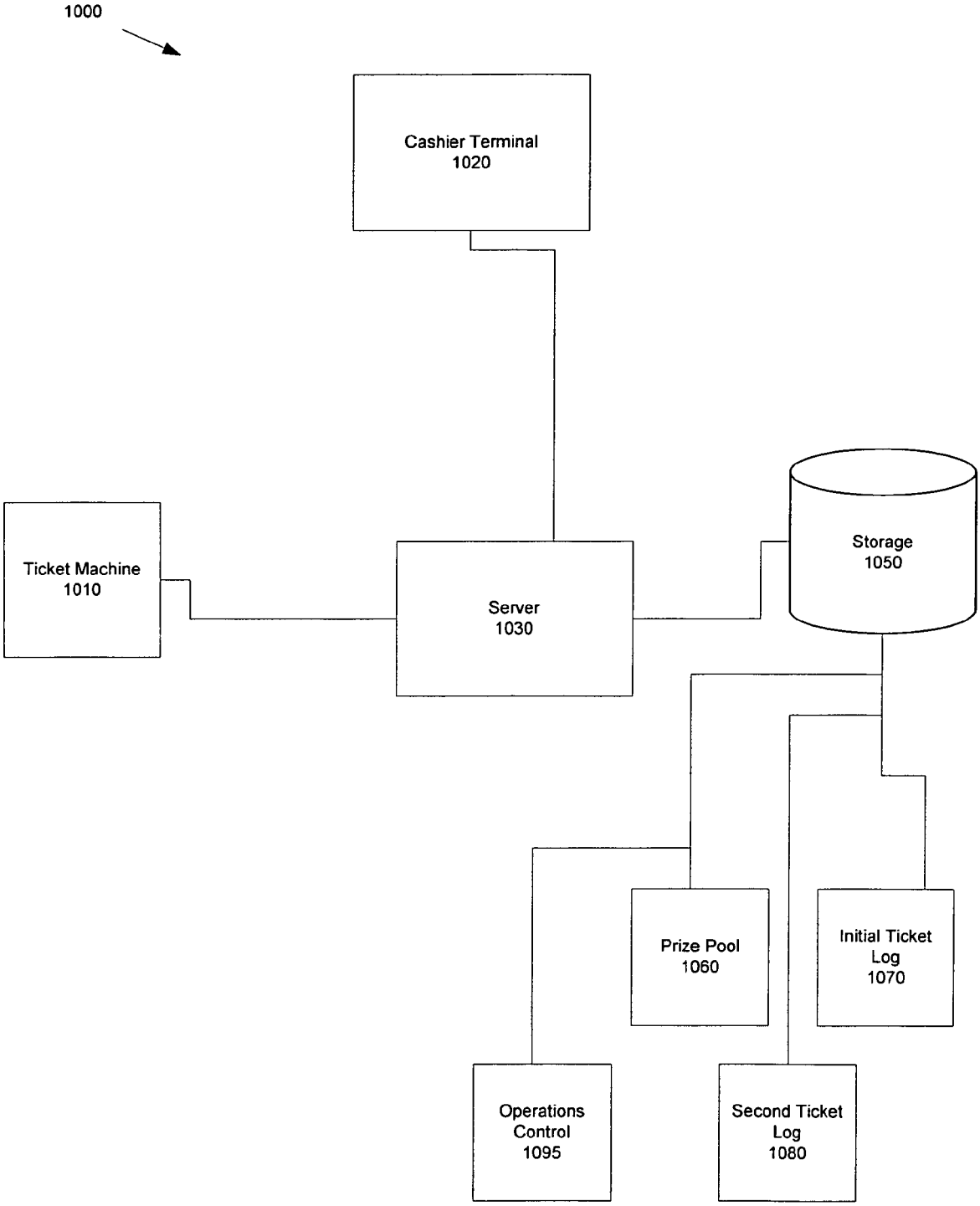
FIG. 10 illustrates an example game chart, according to an example embodiment of the present invention.

FIG. 10 illustrates an example lottery terminal system 1000 in a logical view according to an example embodiment of the present invention. The example lottery terminal system 1000 includes one or more ticket machines 1010, one or more cashier terminals 1020, a server 1030, a storage subsystem 1050, a prize pool 1060, an initial ticket log 1070, a second ticket log 1080, and a game control program 1095.

The server 1030 may include a conventional microprocessor or custom designed control circuitry, and may be in communication with the ticket machine 1010 and cashier terminal 1020. The server 1030 may be used to control the operation of the other components of the lottery terminal system, such as, for example, by executing a control program that facilitates the generation of second tickets. The server 1030 may be configured to control the lottery terminal system in carrying out procedures for facilitating the play of a lottery game, generating and tracking tickets, generating additional game play information, and authenticating and paying winning tickets, as described above.

The storage subsystem 1050 may include RAM, ROM, disk, optical disk, flash memory, or other conventional storage media. The storage subsystem 1050 may be a separate component from the server 1030, or may be included as part of the server 1030.

The storage subsystem 1050 may store programs and data used to control or facilitate the play of lottery games. In particular, the storage subsystem 1050 may store the prize pool 1060, the initial ticket log 1070, the second ticket log 1080, and the game control program 1095.

The prize pool 1060 may contain information related to second tickets that may be sold. For example, each entry in the prize pool 1060 may correspond to a particular second ticket that may be sold, and may contain an indication of whether the particular chance is a winner, a prize amount, as well as information about when and whether a particular chance has been sold.

The initial ticket log 1070 and the second ticket log 1080 may be used to record whether additional game play information has been sold for a particular initial ticket and may facilitate procedures for redeeming both initial and second tickets.

The game control program 1095 may be used to control the sale and redemption of gaming tickets in the procedures for playing and facilitating the play of the ticket games.

It will be appreciated that the programs, prize pool, and ticket logs need not be located in a particular storage subsystem, e.g., they could reside directly on the server. It will also be appreciated that other elements may be included in the example lottery terminal system, e.g. an operations control program, security, auditing capabilities, etc.

Modifications

In the preceding specification, the present invention has been described with reference to specific example embodiments thereof. It will, however, be evident that various modifications and changes may be made thereunto without departing from the broader spirit and scope of the present invention as set forth in the claims that follow. The specification and drawings are accordingly to be regarded in an illustrative rather than restrictive sense.

What is claimed is:

1. A method of playing a game of chance, comprising:

receiving an initial ticket including initial game play information and a unique initial ticket identifier, the initial game play information being sufficient to indicate whether the initial ticket is an initial game winner;

submitting the unique initial ticket identifier as part of a request to purchase additional game play information not found on the initial ticket;

receiving additional game play information not found on the initial ticket when the initial ticket was received, the additional game play information associated with the unique initial ticket identifier; and determining if a player is a winner based upon a combination of the initial game play information and the additional game play information.

2. The method of claim 1 wherein the additional game play information is provided on a second ticket.

3. The method of claim 1 wherein the additional game play information is provided on the initial ticket.

4. The method of claim 1 further comprising:

tendering a winning ticket; and receiving a prize if an authentication code on the winning ticket is validated.

5. The method of claim 2 wherein the second ticket includes a display of the initial game play information.

6. The method of claim 1 further comprising:

determining whether the initial ticket is a winning ticket in the initial game based upon the initial game play information; and receiving increased prize winnings based on the additional game play information alone and on the combination of the initial game play information and the additional game play information.

7. A method for facilitating the play of a game of chance, comprising:

providing an initial ticket including initial game play information and a unique initial ticket identifier, the initial game play information being sufficient to indicate whether the initial ticket is an initial game winner;

receiving a request to purchase additional game play information, the request including the unique initial ticket identifier; and responsive to the request to purchase additional game play information, providing additional game play information associated with the unique initial ticket identifier, wherein whether a player is a winner is determinable based on a combination of the initial game play information and the additional game play information.

8. The method of claim 7 wherein the additional game play information is provided on a second ticket.

9. The method of claim 7 wherein the additional game play information is provided on the initial ticket.

10. The method of claim 7 wherein the initial game play information indicates the initial ticket is not an initial game winner.

11. The method of claim 7 further comprising:

redeeming a winning ticket for a prize indicated by the initial game play information alone.

12. The method of claim 11 further comprising:

maintaining a ticket log that includes information regarding previous sold tickets;

verifying the winning ticket is valid using information from the ticket log.

13. The method of claim 11 further comprising:

redeeming a winning ticket for a prize indicated by a combination of the initial game play information and the additional game play information.

14. The method of claim 7 comprising:

responsive to the request to purchase additional game play information, generating the additional game play information.

15. The method of claim 14 wherein the generating of the additional game play information is based in part on the initial game play information.

16. The method of claim 14 wherein the generating of the additional game play information is based in part on a random selection.

17. The method of claim 7 further comprising:

after receiving the request to purchase additional game play information and prior to providing the additional game play information, determining a game outcome; and after determining the game outcome, generating the additional game play information so that the combination of the initial game play information and the additional game play information reflects the outcome.

18. The method of claim 7 comprising:

populating a prize pool with a plurality of entries, each entry associated with an outcome; and determining an amount of the prize by choosing a random entry in the prize pool.

19. A method for providing a game of chance, comprising:

providing an initial ticket including initial game play information and a unique initial ticket identifier, the initial game play information being sufficient to indicate whether the initial ticket is an initial game winner;

receiving a request to purchase additional game play information;

determining a game outcome;

after determining the game outcome and responsive to the request to purchase additional game play information, determining additional game play information; and displaying the additional game play information on at least one of the initial ticket and a second ticket, wherein the combination of the initial game play information and the additional game play information indicates the game outcome.

20. The method of claim 19, further comprising:

choosing a random entry in a prize pool to determine the game outcome.

21. The method of claim 19 further comprising:

determining if a particular ticket has been previously purchased.

22. The method of claim 19 further comprising:

scanning a second chance code on the initial ticket; and determining whether the initial ticket has been previously tendered for additional game play information.

23. The method of claim 19 further comprising:

examining a ticket log to determine a winning ticket.

24. An article of manufacture comprising a computer-readable medium having stored thereon instructions adapted to be executed by a processor, the instructions which, when executed, define a series of steps to be used to control a method of facilitating a game of chance, the steps comprising:

providing an initial ticket including initial game play information and a unique initial ticket identifier, the initial game play information being sufficient to indicate whether the initial ticket is an initial game winner;

receiving a request to purchase additional game play information;

determining a game outcome;

after determining the game outcome and responsive to the request to purchase additional game play information, determining additional game play information; and displaying the additional game play information on at least one of the initial ticket and a second ticket, wherein the combination of the initial game play information and the additional game play information indicates the game outcome.

25. The article of manufacture of claim 24 wherein the steps further comprises:

choosing a random entry in a prize pool to determine the game outcome.

26. The method of claim 1 wherein the initial ticket is an instant win lottery ticket and the method further comprises:

revealing the initial game play information by removing a scratch-off coating on the instant win lottery ticket concealing the initial game play information.

27. The method of claim 1 wherein the initial ticket is an instant win lottery ticket and the method further comprises:

redeeming the initial instant win lottery ticket for a prize based only on the initial game play information.

28. The method of claim 1 wherein submitting the unique initial ticket identifier includes manually entering the unique initial ticket identifier at a terminal.

29. The method of claim 1 wherein submitting the unique initial ticket identifier includes having a bar code on the initial ticket scanned.

30. The method of claim 2 wherein the second ticket includes the unique initial ticket identifier.

31. A method of playing a game of chance, comprising:

receiving an initial ticket including initial game play information and a unique initial ticket identifier, the initial game play information being sufficient to indicate whether the initial ticket is an initial game winner;

purchasing additional game play information not found on the initial ticket;

receiving the additional game play information on a second ticket which also includes a display of the initial game play information; and determining if a player is a winner based upon a combination of the initial game play information and the additional game play information.

32. The method of claim 4 wherein the winning ticket is tendered without tickets containing the additional game play information, and the prize is based upon a combination of the initial game play information and the additional game play information.

33. A method for facilitating the play of a game of chance, comprising:

providing an initial ticket including a unique initial ticket identifier and initial game play information, the initial game play information being sufficient to indicate whether the initial ticket is an initial game winner receiving a request to purchase additional game play information;

determining an additional game outcome;

after determining the additional game outcome, providing an additional game play information, the additional game outcome being determinable based on a combination of the initial game play information and the additional game play information.

34. The method of claim 33 wherein the additional game outcome is determined after receiving the request to purchase additional game play information.

35. The method of claim 33 further comprising:

as part of providing the additional game play information, providing a second ticket including the additional game play information, the second ticket being associated with the initial ticket; and redeeming the initial ticket for a prize based on the additional game outcome without receiving a tender of the second ticket.

* * * * *